US005954121A

United States Patent [19]

Rexford et al.

[11] Patent Number: 5,954,121

[45] Date of Patent: Sep. 21, 1999

[54] REFRACTORY DIFFUSOR FOR INDUSTRIAL HEAT SOURCE

[75] Inventors: Donald G. Rexford, Pattersonville; Jeffrey J. Bolebruch, Gloversville; David P. Bacchi, Schenectady; Edwin Collins, Albany; Timothy F. Connors, Watervliet, all of N.Y.

[73] Assignee: Blasch Precision Ceramics, Inc., Albany, N.Y.

[21] Appl. No.: 08/886,114

[22] Filed: Jun. 30, 1997

Related U.S. Application Data

[63] Continuation-in-part of application No. 08/630,473, Apr. 10, 1996, Pat. No. 5,647,432.

[51] Int. Cl.[6] ..... F28F 9/02; F28F 19/00

[52] U.S. Cl. ..... 165/78; 165/134.1; 165/175; 165/178

[58] Field of Search ..... 165/134.1, 178, 165/172, 158, 173, 78, 175

[56] References Cited

U.S. PATENT DOCUMENTS

| | | | |
|---|---|---|---|
| 1,624,128 | 4/1927 | Amsler | 165/172 X |
| 3,406,752 | 10/1968 | Lion | 165/178 X |
| 3,903,964 | 9/1975 | Van Doorn et al. | 165/158 |
| 5,647,432 | 7/1997 | Rexford et al. | 165/134.1 |

FOREIGN PATENT DOCUMENTS

| | | | |
|---|---|---|---|
| 492987 | 7/1919 | France | 165/178 |
| 1248568 | 11/1960 | France | 165/178 |
| 748644 | 5/1956 | United Kingdom | 165/172 |

*Primary Examiner*—Leonard Leo
*Attorney, Agent, or Firm*—Wall Marjama Bilinski & Burr

[57] ABSTRACT

A refractory brick particularly suited for constructing a diffusor wall for an industrial heat source. The brick includes a substantially tubular body having a first end, a second end opposed to the first end, an inner surface defining a passageway extending in the longitudinal direction of the body from the first end to the second end, and an outer peripheral surface extending from the first end to the second end. The outer peripheral surface has a complementary shape that allows mating of a plurality of the bricks to form cooperatively a diffusor wall. Mating means is formed on or in the outer peripheral surface for engaging corresponding mating means formed on or in outer peripheral surfaces of adjacent bricks when assembled as a diffusor wall.

16 Claims, 7 Drawing Sheets

REFRACTORY DIFFUSOR FOR INDUSTRIAL HEAT SOURCE

This application is a continuation-in-part of U.S. Ser. No. 08/630,473, filed Apr. 10, 1996, now U.S. Pat. No. 5,647, 432.

BACKGROUND OF THE INVENTION

Large scale heat sources are used for a variety of applications in industry, including sulfur recovery units, waste incinerators, and the like. Such heat sources typically have a construction as shown in FIG. 1, wherein a large-scale heating vessel 1 has a burner 2 on one end and a waste heat boiler 3 on the other end.

Waste heat boilers are commonly used with many types of industrial heat sources to extract heat from waste gases of an industrial process. It may be necessary to extract heat from the waste gas to cause a component thereof to condense, or it may be advantageous to extract heat from the waste gas and use that heat in another process or even to provide heat for the industrial facility.

Generally speaking, a waste heat boiler includes a plurality of metal boiler tubes 4 supported by opposed metal tube sheets 5 (only one tube sheet is depicted in FIG. 1). The tube sheets define a vessel for holding water or some other form of heat transfer medium. Hot waste gas passes through the boiler tubes arranged in the inlet tube sheet and heat is extracted therefrom via heat transfer from the hot gas to the heat transfer medium contained within the confines of the tube sheets.

There are several concerns associated with such industrial heat sources, e.g., incinerators. One concern is the corrosive nature of the heat and gas produced by the incinerator flame, and the damage that such heat and gas can inflict on the metal components of the waste heat boiler. In an effort to deal with this problem, the present inventors disclosed, in copending application Ser. No. 08/630,473, the entirety of which is hereby incorporated by reference, a new refractory ferrule to protect the metal components of the waste heat boiler from the corrosive nature of the incinerator heat/flame. A plurality of refractory ferrules are arranged to form protective wall 7.

Another concern is making use of the full heat exchange capability of the waste heat boiler. That is, the vessel 1 shown in FIG. 1 typically has a length of about 20–30 feet and a diameter of about 6–10 feet. The incinerator flame, however, is typically not as long or wide as the vessel. As a result, only the central tubes of the waste heat boiler receive the main thrust of the incinerator flame and a hot spot is created at the center of the tube sheet.

In an attempt to spread the heat of the incinerator flame across the entire face of the tube sheet of the waste heat boiler, it has become industry practice to erect a diffusor wall 6 between burner 2 and tube sheet 5 of waste heat boiler 3, as shown in FIG. 1, in an attempt to spread the incinerator flame over the full surface of tube sheet 5. Such diffusor walls have been formed of standard refractory brick, typically 9"×4.5"×4.5", in the shape of a standard wall, except that alternating bricks were omitted to give the appearance of a checkerboard (these walls are sometimes referred to as "checkerwalls"). The holes formed in the wall allow passage of the incinerator gas and provide more uniform heat distribution across the entire face of the tube sheet of the waste heat boiler.

This type of wall, however, has several drawbacks. First, the open frontal area of this type of diffusor wall is only about 35%, so that the presence of the wall substantially disrupts the volume flow of heated gas through the waste heat boiler.

Another drawback is that the bricks that make up the wall are mortared in place to withstand the force of the gas passing through the vessel. The service entrance of the vessel is near the burner, and thus the checkerwall, if not equipped with a "manway", must be dismantled each time the tube sheet of the waste heat boiler needs to be serviced or replaced.

Another type of checkerwall has been constructed from a plurality of refractory cylindrical tubes stacked one on top of the other like a pile of firewood. This structure provides greater open frontal area, but still must be dismantled when the tube sheet needs to be serviced. If the refractory tubes are assembled without the use of mortar in order to facilitate disassembly for tube sheet maintenance and repair, then the overall wall is highly unstable in the axial direction of the vessel, and the force of the gas emitted from the burner tends to displace the tubes in the direction of gas flow and collapse the wall.

SUMMARY OF THE INVENTION

The present invention was developed in view of the above-discussed problems with the prior art.

An object of the present invention is to provide a refractory brick particularly suited for use in constructing a diffusor wall of an industrial heat source. The brick includes a substantially tubular body having a first end, a second end opposed to the first end, an inner surface defining a passageway extending in the longitudinal direction of the body from the first end to the second end, and an outer peripheral surface extending from the first end to the second end. The outer peripheral surface has a complementary shape that allows mating of a plurality of the bricks to form cooperatively a diffusor wall. Mating means is formed on or in the outer peripheral surface for engaging corresponding mating means formed on or in outer peripheral surfaces of adjacent bricks when assembled as a diffusor wall.

Another object of the present invention is to provide a diffusor wall that overcomes the problems associated with the above-discussed prior art diffusor walls. The diffusor wall of the present invention includes a plurality of refractory bricks each comprising (i) a substantially tubular body having a first end, a second end opposed to the first end, an inner surface defining a passageway extending in the longitudinal direction of the body from the first end to the second end, and an outer peripheral surface extending from the first end to the second end. The outer peripheral surface has a complementary shape that allows mating of a plurality of the bricks to form cooperatively the diffusor wall. Mating means is formed on or in the outer peripheral surface for engaging corresponding mating means formed on or in outer peripheral surfaces of adjacent bricks when assembled as the diffusor wall. The bricks are stacked one upon another such that the passageways of all the bricks are aligned in substantially the same direction.

A diffusor wall formed of the refractory brick of the present invention overcomes the problems associated with prior art diffusor walls, in that the wall can be assembled without the use of mortar. Accordingly, the wall is very easy to disassemble to allow access to the tube sheet. Additionally, the mating means provided on each brick allows the bricks to be "tied" together, such that the overall stability of the diffusor wall is sufficient to stand up to the force of the exhaust gas emitted by the burner. Still further, when the bricks are formed in the shape of hexagons with a circular passageway formed therethrough, the open frontal area of the overall diffusor wall can reach about 50%, thereby allowing higher volume flow of exhaust gas to pass therethrough.

Yet another object of the present invention is to improve the heat transfer efficiency of a waste heat boiler associated with an industrial heat source. The present invention provides a system that accomplishes this goal by arranging a refractory wall adjacent an upstream side of the waste heat boiler and a diffusor wall upstream from the refractory wall. The refractory wall has a plurality of openings formed therethrough in alignment with tubes formed in the waste heat boiler. This arrangement directs all of the exhaust gas into and through the tubes of the waste heat boiler, as opposed to heating the upstream face of the waste heat boiler itself. Heat transfer through the tubes is much more efficient than heat transfer through the upstream face of the waste heat boiler.

The diffusor wall is positioned upstream from the refractory wall and is designed to spread the intensity of the exhaust gas across the entire surface of the upstream face of the waste heat boiler. If the diffusor wall were omitted, the central tubes of the waste heat boiler would receive the majority of the heat from the exhaust gas and less heat transfer would occur through the perimeter tubes. The diffusor wall is designed to make use of the heat transfer capability of all the tubes in the waste heat boiler.

In a preferred form of the present invention, the refractory wall is built up from a plurality of refractory ferrules positioned in the tube openings of the waste heat boiler and each of the ferrules includes (i) a head portion having a first end defining an inlet of the ferrule, a second end opposed to the first end, an inner surface defining a passageway extending from the first end to the second end, and an outer peripheral surface extending from the inlet first end to the second end. The outer peripheral surface has an outer shape that allows mating of a plurality of the ferrules to form cooperatively a substantially gas-tight barrier between outer peripheral surfaces of adjacent ferrules. A groove is formed in the outer peripheral surface and extends around the circumference thereof. The ferrule also includes a tube portion having a first end joined to the head portion, a second end defining the outlet of the ferrule which is positioned in the opening of each tube in the waste heat boiler, and an inner surface defining a passageway extending from the first end to the outlet second end and merging with the passageway of the head portion.

DETAILED DESCRIPTION OF THE INVENTION

Figure 1:
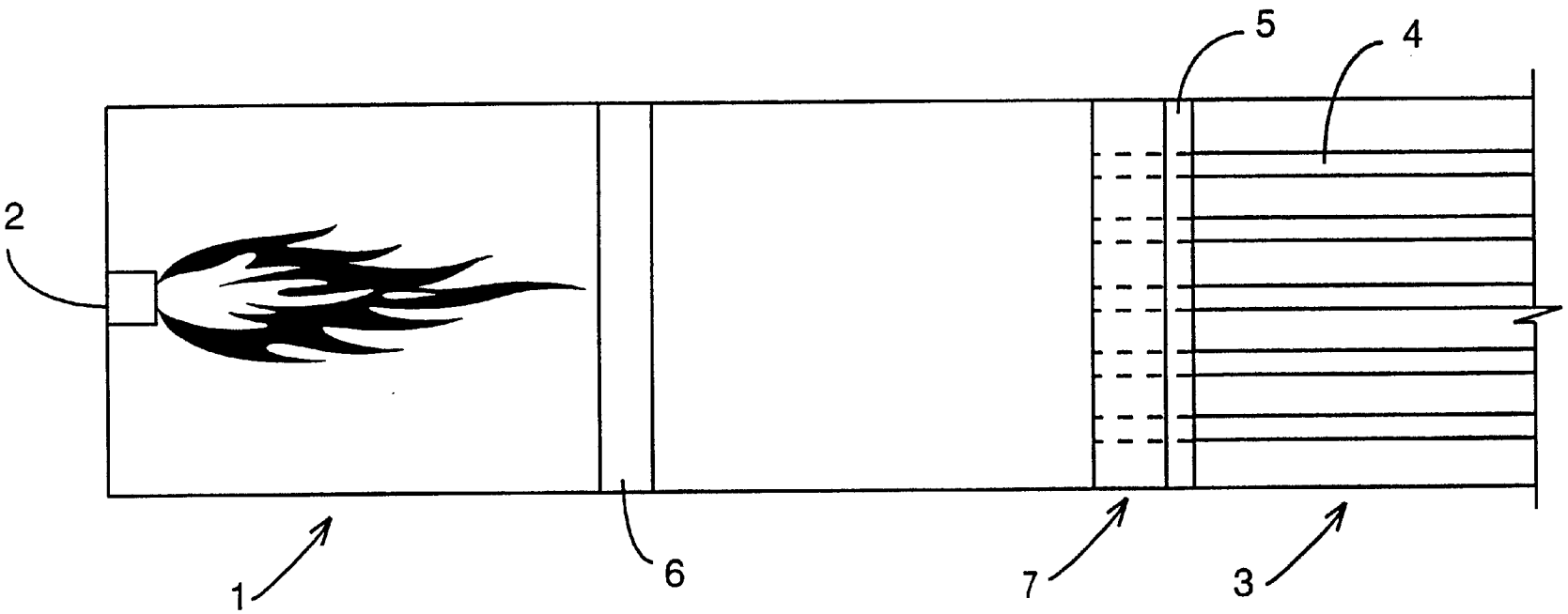
FIG. 1 illustrates the arrangement of a burner, waste heat boiler and diffusor wall in an industrial incinerator.

FIG. 1 shows an industrial heat source, e.g., an incinerator, including a heating vessel 1 that is typically cylindrical in shape having a length ranging from 20' to 30' and a diameter of about 6' to 10'. A burner 2 is arranged at a leading end of vessel 1, and, typically, a waste heat boiler 3 is arranged at the exit end of vessel 1. A service entrance (not shown) is typically arranged proximate the inlet end of vessel 1. In accordance with the invention disclosed and claimed in co-pending application U.S. Ser. No. 08/630,473, refractory ferrules are used to form a refractory wall 7 to protect tube sheet 5 of waste heat boiler 3. In accordance with the present invention, a diffusor wall 6 is disposed between burner 2 and waste heat boiler 3 in order to spread the heat of the incinerator gas along the entire face of tube sheet 5 of waste heat boiler 3.

Figure 2:
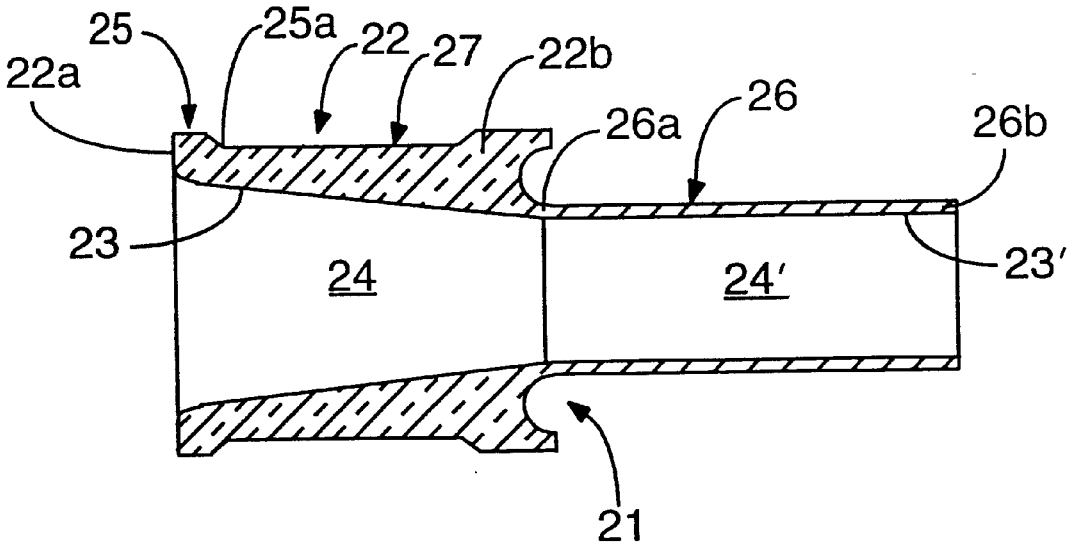
FIG. 2 is a longitudinal cross-sectional view of a ceramic ferrule used to protect the tube sheet of the waste heat boiler.

FIG. 2 is a cross-sectional view of one embodiment of the refractory ferrule 21 used to protect tube sheet 5 of waste heat boiler 3. The ferrule includes a head portion 22 and a tube portion 26.

The head portion 22 of ferrule 21 has a first end 22*a* defining an inlet of the ferrule, a second end 22*b* opposed to first end 22*a,* an inner surface 23 defining a passageway 24 extending from first end 22*a* to second end 22*b,* and an outer peripheral surface 25 extending from first end 22*a* to second end 22*b.* The tube portion 26 of ferrule 21 has a first end 26*a* joined to head portion 22, a second end 26*b* defining the outlet of the ferrule, and an inner surface 23' defining a passageway 24' extending from first end 26*a* to second end 26*b* and merging with passageway 24 of head portion 22.

The outer peripheral surface 25 of head portion 22 has an outer shape that allows mating of a plurality of the ferrules to form cooperatively a substantially gas-tight (with respect to the interfaces between adjacent ferrules) refractory barrier wall. The outer shape, when viewed in a transverse plane of the ferrule (FIG. 3A), can be polygonal (e.g., square or hexagonal).

FIG. 2 shows that head portion 22 includes a groove 27 formed in the outer peripheral surface thereof. Groove 27 preferably extends around the entire circumference of head portion 22, although partial circumferential grooves could be employed.

The manner in which the ferrule engages the tubes of the tube sheet in the waste heat boiler is described in detail in the '473 copending application and thus will not be repeated herein.

Figure 3A:
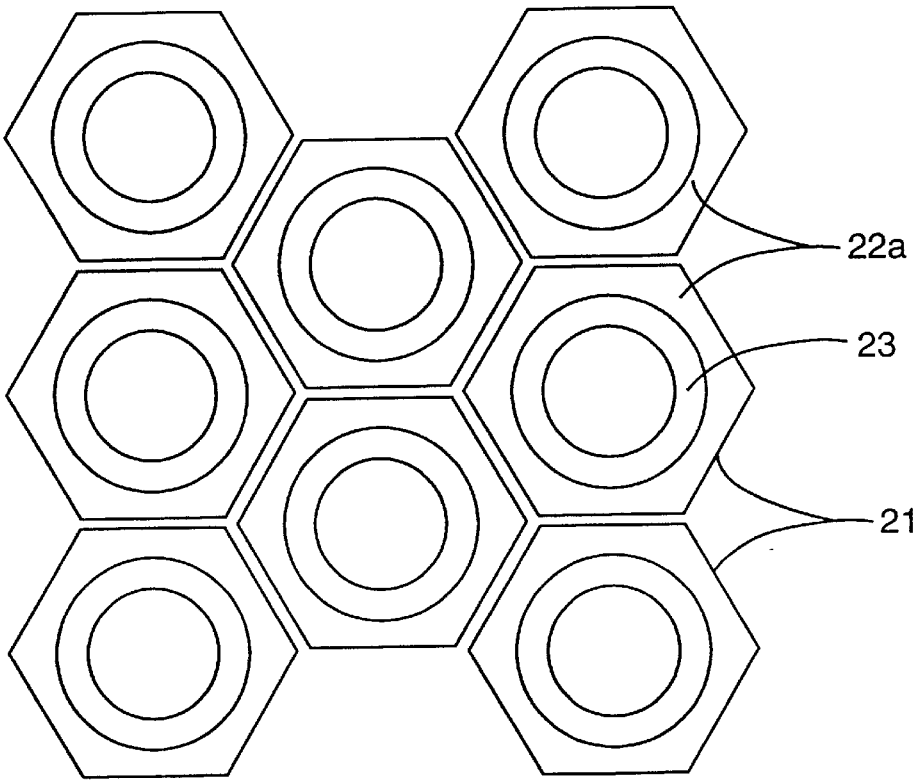
FIGS. 3A and 3B are plan views of an array of ceramic ferrules at room temperature and at the working temperature of the industrial incinerator, respectively.
Figure 3B:
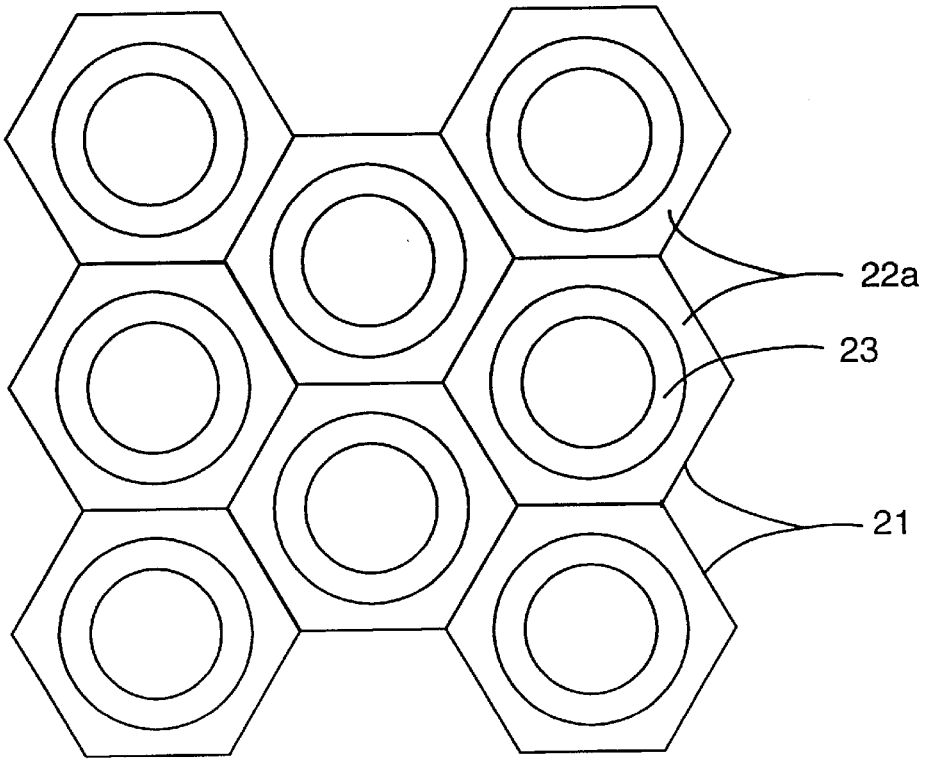

FIG. 3A is a plan view showing an array of ferrules 21 installed in boiler tubes of an inlet tube sheet. The boiler tubes and inlet tube sheet are not shown in FIG. 3A because they are shielded by the head and tube portions of the ferrules. The outer peripheral shapes of the ferrules shown in FIG. 3A are hexagonal, such that outer surfaces of adjacent ferrules will abut each other at the operating temperature of the industrial heat source. More specifically, the ferrules are dimensioned such that the outer peripheral surfaces thereof are spaced from one another when cold (i.e., when the industrial heat source is inoperative) (FIG. 3A), and abut one another at the operating temperature of the industrial heat source (FIG. 3B). The mated ferrules act as a cast refractory wall by shielding the inlet tube sheet from the heat of the waste gas.

Figure 4B:
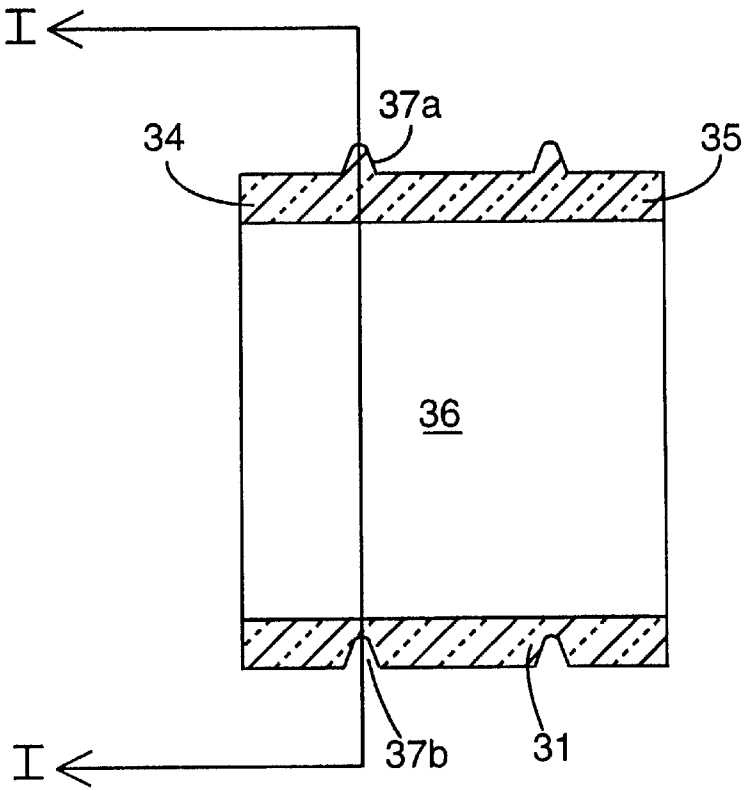
FIG. 4B is a longitudinal cross-sectional view, taken along line II—II of FIG. 4A, of the refractory brick shown in FIG. 4A.
Figure 4A:
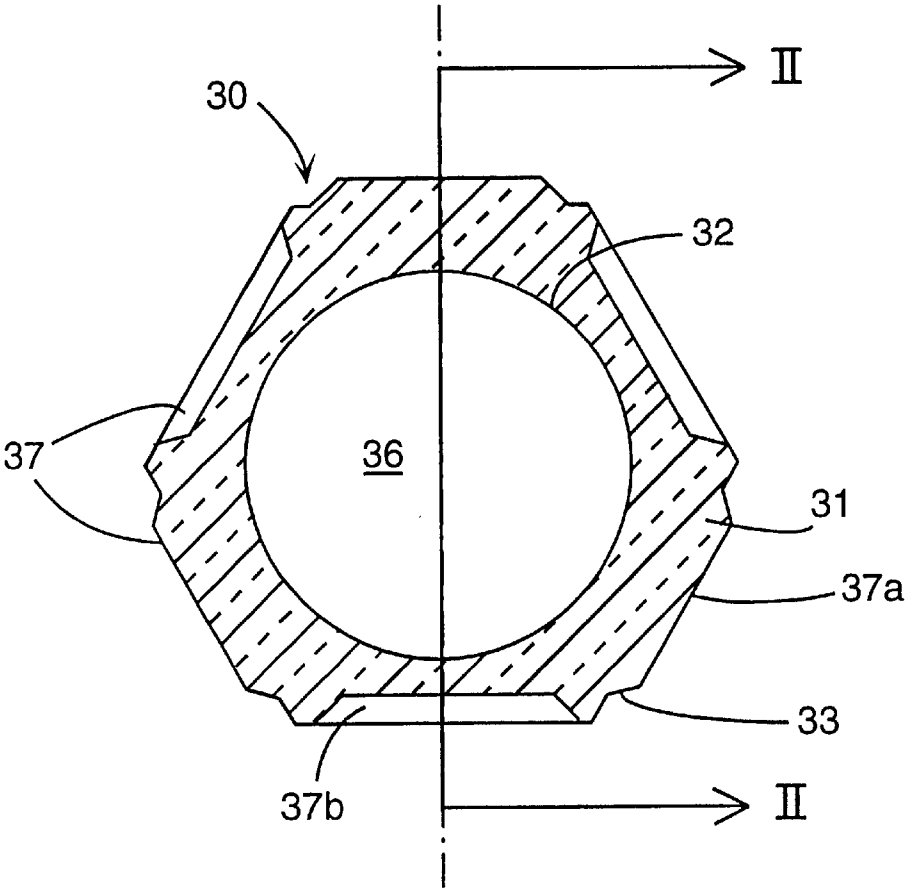
FIG. 4A is a cross-sectional view, taken along line I—I of FIG. 4B, of a refractory brick used to build a diffusor wall in accordance with the present invention.

FIG. 4A is a cross-sectional view of one embodiment of the refractory brick in accordance with the present invention. FIG. 4B is a longitudinal cross-sectional view taken along line I—I of FIG. 4A. The cross-sectional view of FIG. 4A is taken along line II—II of FIG. 4B.

Figure 5:
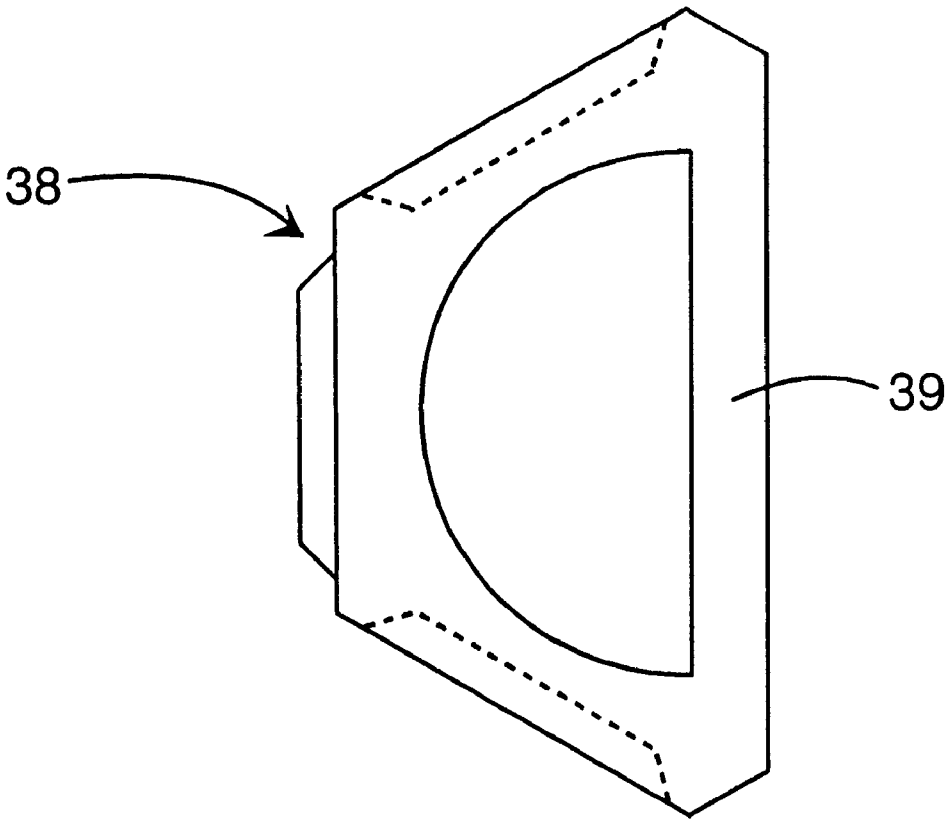
FIG. 5 is a plan view of a half-brick that is otherwise the same as the brick depicted in FIGS. 4A and 4B.

The refractory brick 30 has a substantially tubular body 31. When used herein, the term "tubular" describes bodies that are generally tubular in nature, although the inner and outer peripheral surfaces thereof are not necessarily cylindrical. In a preferred form of the invention as shown in FIG. 4A, the inner surface 32 of tubular body 31 is cylindrical, while the outer peripheral surface 33 of tubular body 31 is hexagonal. FIG. 5, described below, also depicts a substantially "tubular" body.

Body 31 has a first end 34 and a second opposed end 35. The inner surface 32 defines a passageway 36 that extends in the longitudinal direction of body 31 from first end 34 to second end 35. The hot exhaust gas emitted from burner 2 passes through passageways 36 of each refractory brick when a plurality of bricks are assembled to form diffusor wall 6.

While the outer peripheral surface 33 of the refractory brick can have a shape other than hexagonal, that shape preferably should be complementary, such that a plurality of bricks can be stacked one upon another in such a manner that the outer peripheral surface of each brick meets smoothly with the outer peripheral surfaces of adjacent bricks.

Mating means 37 are formed on or in outer peripheral surface 33 of body 31. The mating means preferably are formed as corresponding male and female parts, such as the tongue 37A and groove 37B structures depicted in FIGS. 4A and 4B. The mating means preferably extend in a direction substantially perpendicular to the longitudinal direction of body 31, as shown in FIG. 4B. In the case of a hexagonal-shaped brick as depicted in the drawings, it is preferred to have corresponding male and female mating means on all sides of the outer peripheral surface of the body, such that each refractory brick will interlock with all bricks adjacent thereto. While FIGS. 4A and 4B show the male and female mating parts as alternating along the outer peripheral surface of the refractory brick, it is possible to use any combination of male and female mating parts depending upon the particular application.

FIG. 4B shows that the male and female mating parts are arranged in roughly the same axial plane of body 31. The male and female parts preferably extend around the entire outer peripheral surface of the body and collectively form a group that is positioned on substantially a single axial plane of the body. FIG. 4B shows that a plurality of such groups can be arranged along the body spaced from one another in the axial direction thereof.

The respective dimensions of the tongue and groove structures depicted in FIG. 4A show that it is preferred to leave a space between the interlocking male and female mating structures. That is, the tongue, while having the same general shape as the groove, is dimensioned slightly smaller than the groove. This space simply facilitates assembly of the diffusor wall, in that it is easier to assemble the bricks one upon another if there is a certain degree of "play" between the interlocking structures.

The refractory bricks can be made of any type of refractory material. Many types of ceramic materials are often used in these types of applications. A preferred material is alumina in view of cost and ease of manufacture In this regard, the refractory bricks can be made by any one of several conventional ceramic manufacturing processes such as slip casting, injection molding, extrusion followed by machining, or the like. A preferred method by which the refractory bricks are made is the freeze cast process described in U.S. Pat. No. 4,246,209, which is hereby incorporated by reference in its entirety.

FIG. 5 shows a half-brick 38 that is essentially one-half of the brick shown in FIGS. 4A and 4B with the addition of a closure portion 39. The brick depicted in FIG. 5 is particularly helpful in filling peripheral holes of the diffusor wall and defining manways through the diffusor wall, as described in greater detail below with reference to FIGS. 6 and 7.

Figure 6:
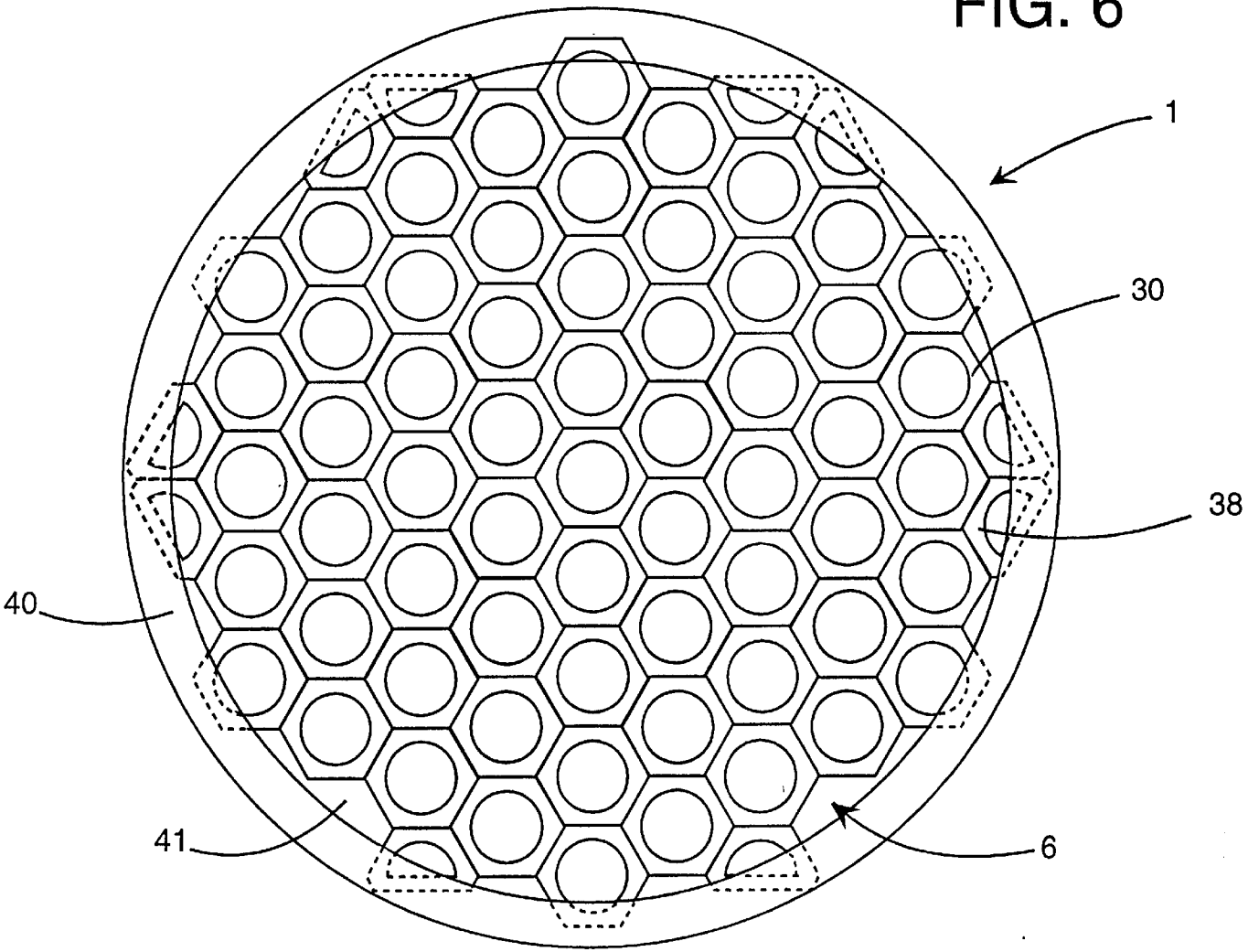
FIG. 6 is an end plan view of a diffusor wall formed of the bricks shown in FIGS. 4A–5.

FIG. 6 is an end plan view of the diffusor wall 6 mounted in the vessel 1, all depicted in FIG. 1. FIG. 6 shows that, due to the complementary shape of the outer peripheral surface of each refractory brick, a structurally sound diffusor wall can be formed by simply stacking the refractory bricks one upon another. It can be understood very easily from viewing FIG. 6 how the mating means of each refractory brick interlocks with the mating means of adjacent refractory bricks. FIG. 6 shows how the half-bricks 38 are employed to fill peripheral holes in the refractory wall. It is unnecessary to use mortar to bond the bricks together since the cooperating mating means provide sufficient structural integrity.

Although the dimensions of each refractory brick can be selected at random, 9" is the preferred length (in the axial direction depicted in FIG. 4B) for each refractory brick, since this is the length of standard refractory bricks used to form the lining 40 of industrial heat sources. In a preferred method of assembling the diffusor wall in accordance with the present invention, the standard refractory bricks are removed from lining 40 to provide an annular slot in the refractory lining of vessel 1. The refractory bricks 30,38, having the same length as the standard refractory bricks removed from the lining 40, are then placed in the annular slot formed in the lining 40. This ties the entire diffusor wall 6 to the overall lining 40 of the vessel 1. And, the mating means formed on each refractory brick ties the bricks to one another to avoid axial displacement of diffusor wall 6 by the force of the exhaust gas emitted from burner 2.

FIG. 6 shows that some additional peripheral voids 41 might exist in the diffusor wall. Those voids can be filled with a standard refractory packing material such as GREEN-PAK 94.

Figure 7:
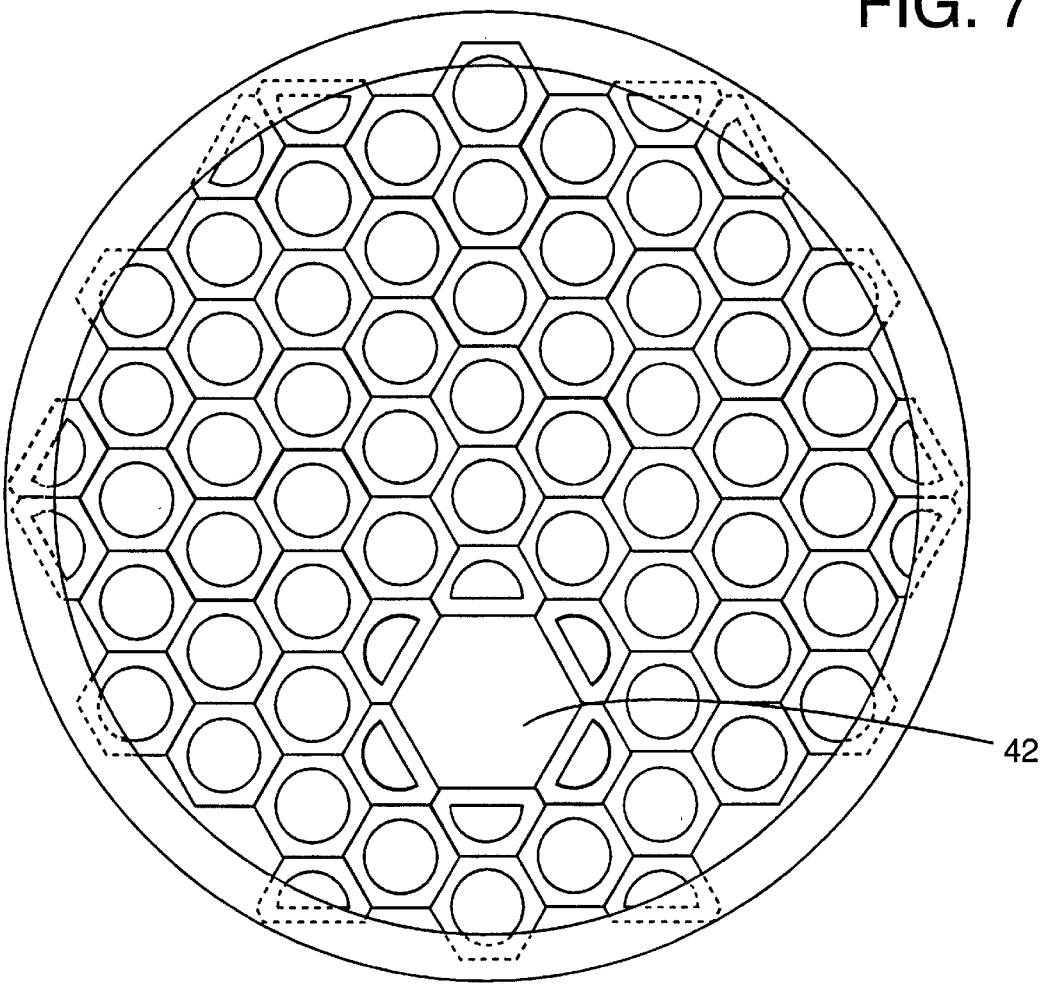
FIG. 7 is an end plan view of a diffusor wall formed of the bricks shown in FIGS. 4A–5, with the addition of a manway.

FIG. 7 shows the same refractory wall as FIG. 6 with the addition of a manway 42 formed by six half-bricks 38. Even though the entire diffusor wall 6 can be easily disassembled since it is unnecessary to use mortar to attach the bricks to one another, it is sometimes preferable to use a manway 42 so that personnel can access the downstream tube sheet for maintenance and service.

The diffusor wall depicted in FIG. 6 has an open frontal area of about 50%, thus allowing a substantial amount of exhaust gas to flow therethrough, as compared to the conventional "checkerwall" formed of standard refractory bricks having an open frontal area of only about 30%.

Another advantage of the refractory bricks and diffusor wall of the present invention is that the wall can be assembled without the need for mortar between adjacent refractory bricks. The mating means formed on the outer surface of each refractory brick ensure that the diffusor wall as a whole will not be shifted axially by the force of the exhaust gas during operation of burner 2. The mating means, in combination with the method of anchoring peripheral refractory bricks in the lining of the heating vessel all but guarantee that the diffusor wall will not collapse under the force of the exhaust gas emitted from burner 2.

While the present invention has been described with reference to preferred embodiments thereof, it is understood that one skilled in the art could make various modifications to the present invention as disclosed herein without departing from the spirit and scope of the claims appended hereto.

What is claimed is:

1. A brick comprising:

a substantially tubular body having a first end, a second end opposed to said first end, an inner surface defining a passageway extending in a longitudinal direction of said body from said first end to said second end, and an outer peripheral surface extending from said first end to said second end, said outer peripheral surface having a complementary shape that allows mating of a plurality of said bricks to form cooperatively a diffusor wall; and a plurality of mating structures formed on or in said outer peripheral surface for engaging corresponding mating structures formed on or in outer peripheral surfaces of adjacent bricks when assembled as a diffusor wall, said mating structures comprising alternating male and female mating parts extending along said outer peripheral surface, such that each male mating part is, along said outer peripheral surface, preceded and followed by a complete female mating part.

2. The brick of claim 1, wherein said mating structures extend in a direction substantially perpendicular to the longitudinal direction of said body.

3. The brick of claim 2, wherein said mating structures extend along said outer peripheral surface at substantially the same axial position along said body.

4. The brick of claim 3, wherein said plurality of mating structures are alternating tongue and groove structures.

5. The brick of claim 4, wherein said plurality of mating structures define a group, and a plurality of said groups are spaced axially from one another along said outer peripheral surface of said body.

6. The brick of claim 3, wherein said plurality of mating structures define a group, and a plurality of said groups are spaced axially from one another along said outer peripheral surface of said body.

7. The brick of claim 2, wherein said mating structures comprise at least one of a tongue and groove structure for interlocking with corresponding groove and tongue structures, respectively, formed in adjacent bricks when assembled as a diffusor wall.

8. The brick of claim 2, wherein said mating structures comprise at least one tongue structure and at least one groove structure, each for interlocking with corresponding groove and tongue structures, respectively, formed in adjacent bricks when assembled as a diffusor wall.

9. The brick of claim 1, wherein the shape of said outer peripheral surface of each brick is polygonal when viewed in a transverse plane of the brick.

10. The brick of claim 9, wherein said outer shape is hexagonal.

11. The brick of claim 1, wherein said brick comprises refractory material.

12. The brick of claim 11, wherein said brick comprises alumina.

13. A diffusor wall, comprising a plurality of bricks each comprising (i) a substantially tubular body having a first end, a second end opposed to said first end, an inner surface defining a passageway extending in a longitudinal direction of said body from said first end to said second end, and an outer peripheral surface extending from said first end to said second end, said outer peripheral surface having a complementary shape that allows mating of a plurality of said bricks to form cooperatively the diffusor wall; and (ii) a plurality of mating structures formed on or in said outer peripheral surface for engaging corresponding mating structures formed on or in outer peripheral surfaces of adjacent bricks when assembled as the diffusor wall, said mating structures comprising alternating male and female mating parts extending along said outer peripheral surface, such that each male mating part is, along said outer peripheral surface, preceded and followed by a complete female mating part, wherein said bricks are stacked one upon another such that the passageways of all the bricks are aligned in substantially a common direction.

14. A diffusor wall, comprising a plurality of bricks each comprising a substantially tubular body having a first end, a second end opposed to said first end, an inner surface defining a passageway extending in a longitudinal direction of said body from said first end to said second end, and an outer peripheral surface extending from said first end to said second end, said outer peripheral surface having a hexagonal shape, when viewed in a transverse plane of the brick, such that a plurality of said bricks mate to form cooperatively the diffusor wall, each said brick including a plurality of mating structures formed on or in said outer peripheral surface for engaging corresponding mating structures formed on or in outer peripheral surfaces of adjacent bricks when assembled as the diffusor wall, said mating structures comprising alternating male and female mating parts extending along said outer peripheral surface, such that each male mating part is, along said outer peripheral surface, preceded and followed by a complete female mating part, wherein said bricks are stacked one upon another such that the passageways of all the bricks are aligned in substantially a common direction.

15. A system for improving the heat transfer efficiency of a waste heat boiler associated with an industrial heat source, comprising:

a refractory wall positioned adjacent an upstream side of the waste heat boiler and having a plurality of openings formed therethrough in alignment with tubes formed in the waste heat boiler; and a diffusor wall positioned upstream from the refractory wall and comprising a plurality of bricks each comprising (i) a substantially tubular body having a first end, a second end opposed to said first end, an inner surface defining a passageway extending in a longitudinal direction of said body from said first end to said second end, and an outer peripheral surface extending from said first end to said second end, said outer peripheral surface having a complementary shape that allows mating of a plurality of said bricks to form cooperatively the diffusor wall, and (ii) a plurality of mating structures formed on or in said outer peripheral surface for engaging corresponding mating structures formed on or in outer peripheral surfaces of adjacent bricks when assembled as the diffusor wall, said mating structures comprising alternating male and female mating parts extending along said outer peripheral surface, such that each male mating part is, along said outer peripheral surface, preceded and followed by a complete female mating part, wherein said bricks are stacked one upon another such that the passageways of all the bricks are aligned in substantially a common direction.

16. A system for improving the heat transfer efficiency of a waste heat boiler associated with an industrial heat source, comprising:

a refractory wall positioned adjacent an upstream side of the waste heat boiler, said wall comprising a plurality of refractory ferrules positioned in the tube openings of the waste heat boiler, each said ferrule comprising:

(i) a head portion having a first end defining an inlet of the ferrule, a second end opposed to said first end, an inner surface defining a passageway extending from said first end to said second end, and an outer peripheral surface extending from said inlet first end to said second end, said outer peripheral surface having an outer shape that allows mating of a plurality of said ferrules to form cooperatively a substantially gas-tight barrier between outer peripheral surfaces of adjacent ferrules, and a groove formed in said outer peripheral surface and extending around the circumference thereof; and (ii) a tube portion having a first end joined to said head portion, a second end defining the outlet of the ferrule which is positioned in the opening of each tube in the waste heat boiler, and an inner surface defining a passageway extending from said first end to said outlet second end and merging with the passageway of said head portion; and a diffusor wall positioned upstream from said refractory wall.

* * * * *